United States Patent [19]

Hosoi et al.

[11] 4,227,925

[45] Oct. 14, 1980

[54] HEAT-RESISTANT ALLOY FOR WELDED STRUCTURES

[75] Inventors: Yuzo Hosoi; Noboru Shinoda, both of Tokyo; Yutaka Tsuchida, Kawasaki; Shozo Sekino, Kitakyushi; Mizuo Sakakihara, Munakata; Shoji Murota, Kitakyushi, all of Japan

[73] Assignee: Nippon Steel Corporation, Tokyo, Japan

[21] Appl. No.: 886,655

[22] Filed: Mar. 15, 1978

Related U.S. Application Data

[63] Continuation-in-part of Ser. No. 832,671, Sep. 12, 1977, abandoned, which is a continuation of Ser. No. 637,962, Dec. 5, 1976, abandoned, which is a continuation-in-part of Ser. No. 548,878, Feb. 10, 1975, abandoned.

[30] Foreign Application Priority Data

Sep. 6, 1974 [JP] Japan ..... 49-102644

[51] Int. Cl.[2] ..... C22C 19/05

[52] U.S. Cl. ..... 75/171; 148/32; 148/32.5

[58] Field of Search ..... 75/171, 170; 148/32, 148/32.5

[56] References Cited

U.S. PATENT DOCUMENTS

| | | | |
|---|---|---|---|
| 3,832,167 | 8/1974 | Shaw et al. | 75/171 |
| 3,865,581 | 2/1975 | Sekino et al. | 75/171 |
| 3,907,552 | 9/1975 | Kennedy | 75/171 |

*Primary Examiner*—R. Dean

*Attorney, Agent, or Firm*—Toren, McGeady and Stanger

[57] ABSTRACT

A heat-resistant alloy suitable for welded structures, particularly suitable for nuclear reactors, and free from the adverse effect of the cobalt used therein, which alloy has a basic composition comprising; 0.01–0.2% C, not more than 0.50% Si, not more than 0.50% Mn, 10 to 25% Cr, not more than 0.030% B, not more than 0.50% Zr, not more than 20% of (Mo+½W), 0.001 to 0.04% Y, not more than 2.0% Al, and not more than 1.0% Ti, with the balance being Ni and unavoidable impurities.

2 Claims, 3 Drawing Figures

HEAT-RESISTANT ALLOY FOR WELDED STRUCTURES

CROSS REFERENCE TO RELATED APPLICATIONS

This application is a Continuation-in-Part application of application Ser. No. 832,671, filed Sept. 12, 1977, abandoned, which, in turn, was a continuation of application Ser. No. 637,962, filed on Dec. 5, 1976, abandoned, which, in turn, is a Continuation-in-Part application of Ser. No. 548,878, filed on Feb. 10, 1975, abandoned.

BACKGROUND OF THE INVENTION

1. Field of the Invention

The present invention relates to a heat-resistant nickel-base alloy having excellent high temperature strength and weldability.

2. Description of the Prior Art

With the recent technical progress in the nuclear reactors, a high temperature gas reactor has been developed, and demands have been made for development of a heat-resistant material which is stable for a long period at high temperatures above 700° C. Thus, trials have been made for using the high temperature gas coming out of the gas reactor for power generation and heat treatment and heat-resistant alloys, such as, Cr-Ni-Ti-Fe alloys and Ni-Mo-Fe alloys have been used as materials for the heat transferring pipes and tubes. However, these conventional alloys can not maintain high strength in a stable manner for a long period at high temperatures above 900° C.

The present inventors have made extensive studies for developing a heat-resistant alloy for welded structures, which shows stable high strength at high temperatures above 900° C. and good weldability as well as excellent hot workability, and have made extensive experiments on various alloy compositions.

However, when heat-resistant alloys are used in the primary system of a high temperature gas nuclear reactor, a problem arises if the alloys contain cobalt since this cobalt is entangled into the oxide scale which is formed on the surface of the alloys under some circumstances, and this oxide scale peels off and is radiated within the reactor, and its induced radioactivity causes difficulties.

SUMMARY OF THE INVENTION

The present inventors have found that in the case of nickel-base alloys containing Cr and Mo, for example a 22Cr-9Mo-Ni alloy, the high temperature strength increases as the cobalt content increases and reaches its maximum with a cobalt content of about 12%. However, even when cobalt is not present, a similar level of high temperature strength can be obtained, if an appropriate amount of Mo and W is added.

At high temperatures of above 0.6 Tm (Tm: a melting point of a metal or alloy expressed in absolute temperature), the creep rate of a metal or alloy depends mainly on the diffusion rate of the metal or alloy, and a metal or alloy having a lower diffusion rate shows less creep. If the crystalline systems of the metals are the same, the activating energy for diffusion is higher (namely less diffusionability) in a metal having a larger atomic valence or a higher melting point. W and Mo have an atomic valence of 4 and 6, respectively, and a melting point of 3382° C. and 2620° C., respectively.

It is expected that addition of these elements to nickel-base alloys will increase the activation energy of creep, thus lowering the diffusion rate or creep rate.

However, when W and/or Mo are added in excess, the secondary phase which is rich in W and/or Mo is precipitated as mentioned before to lower the ductility and toughness of the alloys, and further makes the grain size small, and the diffusion along the grain boundaries takes place more easily, thus lowering the creep strength.

The gist in the present invention lies in that W and Mo are added in combination to nickel-base alloys containing no cobalt in an amount most appropriate in respect of the high temperature strength.

The basic composition of the alloy of the present invention comprises:

C: 0.01–0.20%
Si: not more than 0.50%
Mn: not more than 0.50%
Cr: 10 to 25%
B: not more than 0.030%
Zr: not more than 0.50%
Mo+½W: not more than 20 and preferably 5 to 20%
Y: 0.001 to 0.04%
Al: not more than 2.0%
Ti: not more than 1.0%
Balance: Ni and unavoidable impurities The basic composition of the alloy of the present invention may be modified by comprising:

Mo+½W: 5 to 20%
W: 10 to 20% when Mo is less than 10%
Mo: 10 to 16% when W is 3 to 10%

The basic composition of the alloy of the present invention may be further composed of:

One or more of Ce, La, Mg, Ca, Nb, Ta, V and Hf in the following amount

Ce, La, Mg, Ca: 0.001 to 0.050% for each and not more than 0.1% in total
Nb, Ta, V, Hf: 0.001 to 3.0% for each and not more than 3.0% in total Another modification of the basic composition comprises:

Mo+½W: 5 to 20%
W: 10 to 20% when Mo is less than 10%
Mo: 10 to 16% when W is 3 to 10% one or more of Ce, La, Mg, Ca, Nb, Ta, V and Hf in the following amount,

Ce, La, Mg, Ca: 0.001 to 0.050% for each and not more than 0.1% in total
Nb, Ta, V, Hf: 0.001 to 3.0% for each and not more than 3.0% in total Particularly, the present invention comprises a heat-resistant alloy having a composition within the above-defined ranges and wherein the tungsten and molybdenum contents in percent by weight lie within the area defined by the points a, b, c, d, e, and f of FIG. 3.

Thus, the alloy of the present invention does not contain cobalt and is very suitable for nuclear reactor materials.

DESCRIPTION OF THE PREFERRED EMBODIMENT

Figure 1:
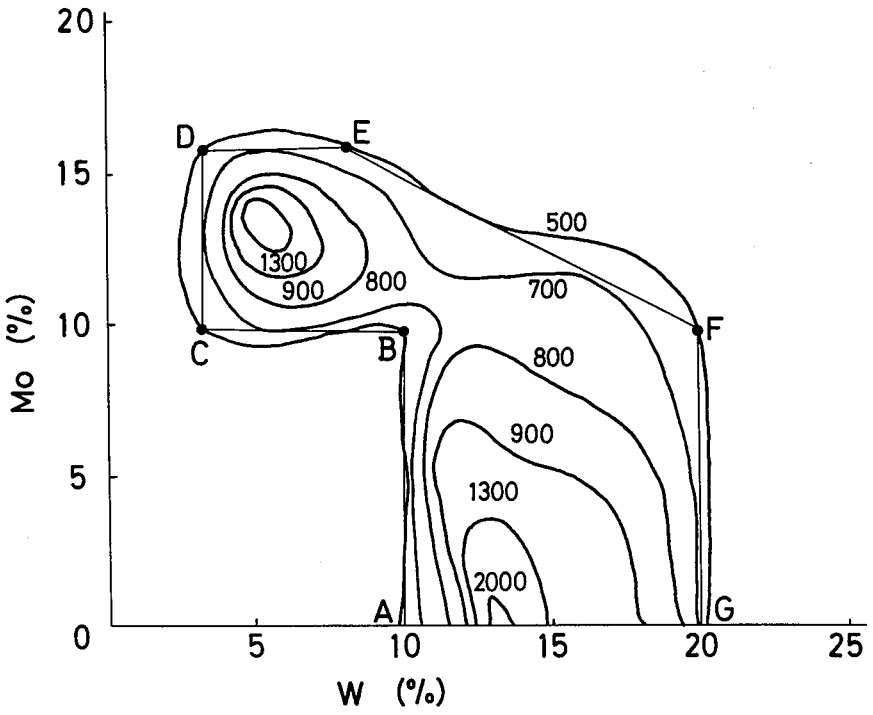
FIG. 1 is a graph of the relationship between the creep rupture time and the molybdenum and tungsten contents.

The reasons for the limitations of the individual elements in the alloy composition according to the present invention will be explained hereinafter.

Carbon combines with carbide formers, such as, Cr, Ti, Mo and W to form fine carbides, and in this way is effective to improve the heat-resistant properties, such as, the tensile strength and creep rupture strength required for heat-resistant alloys. For this purpose, not less than 0.01% of carbon is necessary. On the other hand, excessive carbon contents cause the formation of initial coarse carbides, thus resulting in deterioration of the hot workability of the alloy. Consequently, the upper limit of the carbon content is defined as about 0.2%.

Silicon is effective, when present in an austenite alloy such as the present invention, to enhance oxidation resistance of the alloy at high temperatures, and is also effective as a deoxidizing agent during the melting step. However, an excessive addition of silicon increases the inclusions in the alloy, deteriorates the hot workability and lowers the creep rupture strength, thus remarkably damaging weldability. Thus, the upper limit of the silicon content is defined as being 0.5%.

Manganese is effective as a deoxidizing agent during the melting step, but manganese contents beyond 0.5% lower the strength and oxidation resistance of the alloy at high temperatures. Thus, the upper limit of the manganese content is defined as about 0.5%.

Chromium is commonly added in an amount not less than 15% in order to improve the heat-resistance at high temperatures. The present inventors have conducted experiments with various chromium contents between 5 and 30% in order to determine the effects of the chromium content on the high temperature properties. The results of the experiments have revealed that with a chromium content between 10 and 25%, excellent creep rupture strength can be obtained when W and Mo are added in combination. Thus, chromium contents less than 10% will lower the creep rupture strength and oxidation resistance remarkably. On the other hand, chromium contents beyond 25% lowers the hot workability and makes the alloy matrix unstable when heated at 1000° C. for a long time, thus lowering the creep rupture strength. Based on the above facts, the chromium content is limited to the range of from about 10 to 25% in the present invention. Regarding molybdenum and tungsten which are added in combination with chromium, further improvement of the creep rupture strength can be realized when they are contained in an amount of not more than 20%, and, under the conditions that 10 to 20% W when $Mo+\frac{1}{2}W=5$ to 20%, W is from 10 to 20% when Mo is less than 10%, and 10 to 16% Mo when W is 3 to 10%.

When these elements are present in amounts less than the lower limits, satisfactory solid solution hardening at high temperatures beyond 900° C. can not be obtained. Hence, only low creep rupture strength is obtained. On the other hand, when these elements are present in excess of their upper limits, the strain of the alloy matrix is excessively large, thus damaging the stability of the structure when heated for a long time, the coagulation of the carbides, and producing lower creep rupture strength.

The present invention will be described in more detail referring to the attached drawings.

FIG. 1 shows the relation between the creep rupture time and the molybdenum and tungsten contents. For satisfying the creep strength at high temperature which is one of the purposes of the present invention, the zone defined by A B C D E F G is most desirable, because at least 500 hours of creep rupture time at 1000° C. with 2.5 kg/mm$^2$ is required, and the difficulties caused by cobalt when the alloy is used in nuclear reactors can be completely avoided since no cobalt is present.

Yttrium is added in an amount between 0.001 and 0.04% to improve the creep rupture strength. Yttrium contents outside this range show no substantial effect or cause welding cracks and deteriorate the hot workability.

With a yttrium content beyond 0.04%, too large an amount of Y remains as solid solution in the matrix other than Y which has combined with S and O, and this residual Y forms Ni-Y-Si which precipitates in the grain boundary, causing weld cracks, lowering the creep rupture strength, and deteriorating the hot workability.

It is known that it is useful to lower the sulfur and oxygen contents to improve the creep rupture strength and hot workability. The present inventors have conducted various studies on the relationship between the S and O contents, and the Y and Zr contents and have found that the combined addition of Y and Zr is effective for fixing the S and O. They have further found that when the proportions of these elements are controlled under the conditions of the following formula, very advantageous results can be obtained.

$$Y_E=[Y]\%+1/5[Zr]\%-1.85[S]\%-3.7[O]\%$$

in which $Y_E$ is the effective content of Y.

The relationship between $Y_E$ and the creep rupture strength at 1000° C. (3.5 kg/mm$^2$) is shown in FIG. 2.

Figure 2:
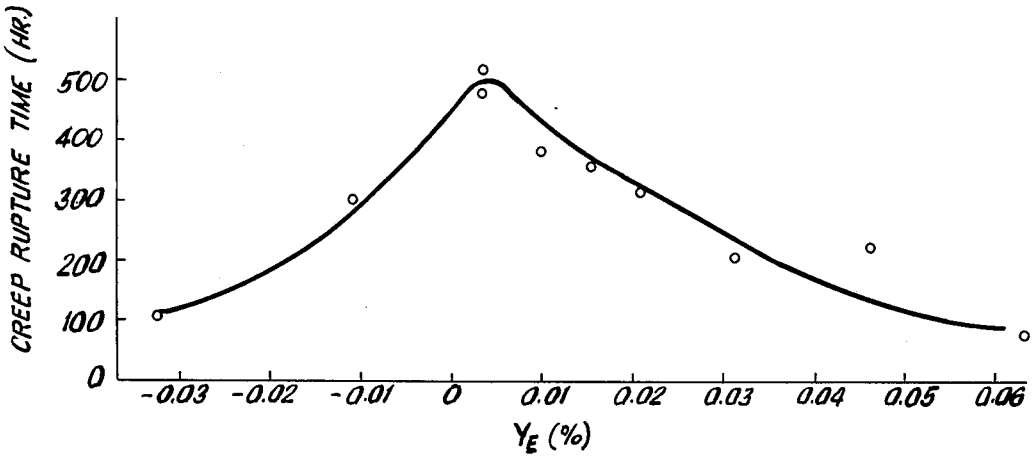
FIG. 2 is a graph of the relationship of the effective Y content and the creep rupture time.

As shown in FIG. 2, $Y_E$ should be between −0.01 and 0.02% for obtaining a creep rupture strength of more than 300 hours, and this range of $Y_E$ is preferable for the object of the present invention.

Y combines with S and O in the alloy to form sulfide and oxide. Therefore $Y_E$ means $$Y_E=\text{Y in solid solution}+Zr=(\text{content of Y and Zr})-(\text{Y which has combined with S and O})$$

In this case, Zr has similar function as Y but its activity is 1/5 of Y. Therefore, the coefficient of 1/5 is defined.

Therefore, when the contents of S and O are high, even when they combines with Y completely, some of S and O remains. Therefore in order to assure positive $Y_E$, Y and Zr in an amount more than that corresponding to the remaining S and O must be present. Thus, when the contents of S and O are high, $Y_E$ becomes negative, but until Y reaches −0.01% satisfactory desulfidation and deoxidation are attained as shown in FIG. 2, and even if S and O remain their adverse effect become very small so that the range from −0.01~0.02% is preferable for $Y_E$. Naturally, when $Y_E=0\%$, the whole of S and O combines with Y and the amount of Y+1.5 Zr is not excessive. Thus, this cost is most preferable.

Boron and zirconium are effective to improve the hot workability and creep rupture strength, and for this purpose, boron is present in an amount of not more than 0.030% and zirconium is present in an amount of not more than 0.5%. Boron and zirconium contents beyond these amounts have adverse effects, such as, causing welding cracks.

Aluminum and titanium are contained in an amount of not more than 2.0% and in an amount not more than 1.0%, respectively, but within a range which does not cause welding cracks due to gamma prime precipitation caused during the cooling step after welding or during the ageing step, and to improve the creep rupture strength of nickel-based alloys. A higher aluminum, and especially a higher titanium content, deteriorates the corrosion resistance in helium or a reducing gas atmosphere.

The most desirable aluminum and titanium contents are 0.2 to 1.0% for aluminum and 0.2 to 0.5% for titanium with Al/Ti being from 1.0 to 2.2.

As described hereinbefore, cobalt is not added, but a small amount of cobalt is normally contained in nickel, and the cobalt contents in the most popular stainless steels produced nowadays in the world are as follows:

U.S.A.: 0.066%

Germany: 0.078%

Japan: 0.134–0.150%

Therefore, some of these nickel-base alloys contain from 0.1 to 0.2% cobalt. In the U.S.A. the cobalt content in the 18–8 stainless steels is specified as follows:

For general use in nuclear reactors: Co<0.2%

For nuclear reactor cores: Co<0.02%

Therefore, in the present invention, too, it is natural that the cobalt content in the nickel must be maintained as low as possible.

The unavoidable impurities, such as, P and S in the nickel-base alloy of the above defined composition must be maintained as low as possible because these elements deteriorate the hot workability of the alloy.

Iron in a small amount does not have an adverse effect. However, iron contents beyond 18% lower the hot workability and creep rupture strength, and thus the iron content is maintained at less than 18%.

In addition to the above basic alloy composition, one or more of Ce, La, Mg, Ca, Nb, Ta, V and Hf is added in order to further improve the hot workability in an amount between 0.001 and 0.050% for each of Ce, La, Mg and Ca, the total amounts being not more than 0.1%, and in an amount between 0.001 and 3.0% for each of Nb, Ta, V and Hf, the total amount being not more than 3.0%.

Ce, La, Mg and Ca are effective to remove oxygen and sulfur in the alloy as oxides and sulfides, or to finely disperse them in the grains to clean the grain boundaries, thus improving the hot workability. While Nb, Ta, V and Hf are effective to improve the creep rupture strength by forming fine carbides, excessive contents of these elements cause grain boundary precipitation and form coarse grains, thus offsetting the above desirable effect.

The heat resistant alloy of the present invention may be melted by an ordinary melting method, such as, by a vacuum melting furnace, an electric furnace, and an electroslag melting furnace to obtain ingots by breaking down, or to obtain slabs or billets by continuous casting, and then the slab or billets are subjected to hot rolling into sheets, strips and pipes, etc., which may be subjected, if necessary, to tempering, heat treatment, and cold working.

Figure 3:
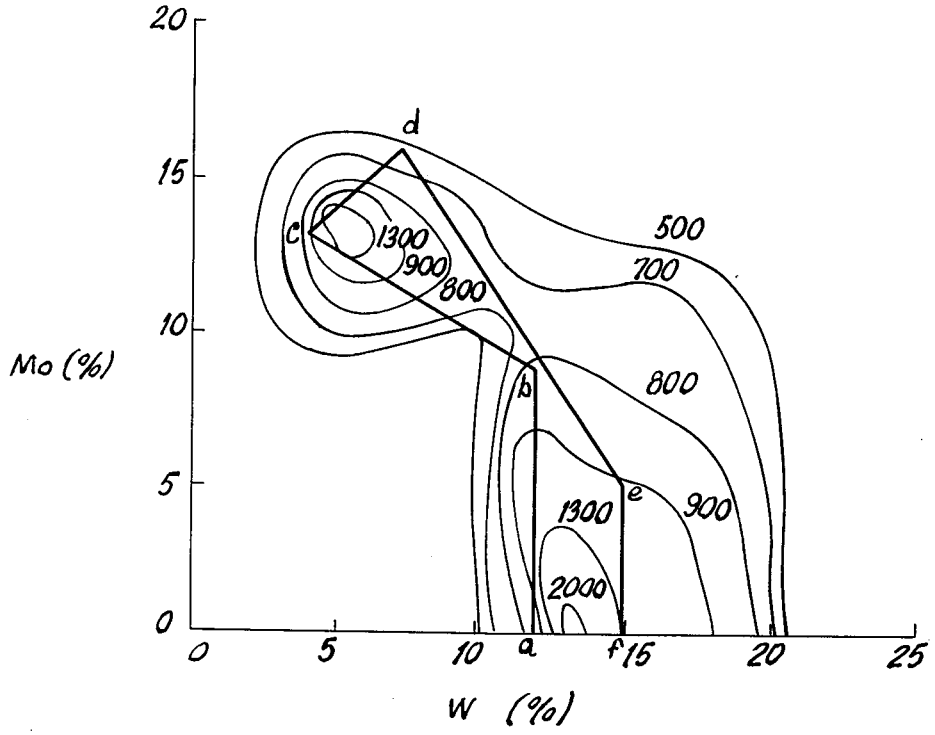
FIG. 3 is a graph of the relationship of the molybdenum to tungsten and defines the compositional ranges of each of these elements in the composition of the present invention.

Referring to FIG. 3, the compositional ranges of molybdenum and tungsten are defined by the points a through f shown therein. Thus, the contents of molybdenum and tungsten which are added in combination with chromium for increasing the creep rupture strength are such that:

$$Mo+\tfrac{1}{2}W=5 \text{ to } 20\%$$

when Mo is less than 10%, W is 10 to 20%, and when W is 3 to 10%, Mo is 10 to 16%.

The specific points a through f shown in FIG. 3 have the following values:

| | Mo | W |
|---|---|---|
| a | 0 | 12.0 |
| b | 9.0 | 12.0 |
| c | 13.2 | 4.3 |
| d | 15.8 | 7.2 |
| e | 4.7 | 14.9 |
| f | 0 | 14.5 |

Thus, when the amount of these components is less than the lower limits, satisfactory strength at temperatures above 900° C. cannot be achieved by the solid solution thereof and the creep rupture strength is low. Beyond the upper limits of the values shown for these components, the strain on the matrix is extremely large, such that the stability of the structure is poor when heated for a long time. This results in a coagulation of the carbides which tends to lower the creep rupture strength. Consequently, there is advantage to having higher amounts of these materials particularly in view of the increased cost which would be attributable to the increased amounts of the alloying elements.

As shown in FIG. 3, in order to obtain a satisfactory creep rupture strength at high temperatures which is the purpose of the present invention, one wants to obtain a creep rupture time of 500 hours or longer. Preferably, this is longer than 700 hours at 1000° C. and 2.5 kg/mm$^2$. These values are obtained when the range is within the points a, b, c, d, e, and f. Additionally, when the composition is within this range, the problems which are caused by cobalt when these materials are used for a nuclear furnace can be avoided since cobalt is not present.

One example of the present invention will be described hereinunder.

Heat-resistant alloy sheets of 15 mm thickness obtained by melting in an electric furnace and an electroslag melting furnace, ingot-making, breaking-down, hot rolling and heat treatment were subjected to creep rupture tests at 1000° C. with a stress of 2.5 kg/mm$^2$, and to tig weld cracking test using a matching wire made of the alloy of the present invention. The results of these tests are shown in the table.

Although not shown in the table, the creep rupture strength of the weldment made using the matching wire was as good as that of the base portion of the alloy of the present invention. This means that the alloy of the present invention can be satisfactorily used as welding material.

As shown by the results in the table, the heat-resistant alloys of the present invention show a longer rupture time than that of the comparative alloys and exhibit no welding cracks.

As described above, the alloy of the present invention can be used safely as nuclear reactor materials without the danger being effected by the radioactivity resulting from the cobalt content of the alloy material.

the alloy possesses a creep rupture strength of more than about 300 hours and wherein the amount of tungsten and molybdenum is within the area defined by the points a, b, c, d, e, and f of FIG. 3 hereof.

| | Designation of Alloys | Alloy Compositions (%) C | Si | Mn | Cr | Mo | W | Fe | Al | Ti | B | Zr | Y | Optional Elements | Rupture Time with 2.5 kg/mm² Stress at 1000° C.(h) | Hot Cracking Rate (%) at TIG Welding* |
|---|---|---|---|---|---|---|---|---|---|---|---|---|---|---|---|---|
| Alloys of Present Invention | A | 0.07 | 0.07 | 0.10 | 22.5 | 0.49 | 14.5 | — | 0.97 | 0.39 | 0.003 | 0.008 | 0.03 | | 1000 | 0 |
| | B | 0.06 | 0.06 | 0.08 | 18.1 | 0.48 | 12.9 | — | 0.99 | 0.39 | 0.004 | 0.009 | 0.03 | Hf : 1.5 | 2176 | 0 |
| | C | 0.06 | 0.07 | 0.07 | 17.9 | 0.50 | 12.0 | — | 0.97 | 0.40 | 0.003 | 0.008 | 0.03 | | 1353 | 0 |
| | D | 0.08 | 0.47 | 0.25 | 22.6 | 7.7 | 12.8 | 7.9 | 0.50 | 0.24 | 0.005 | 0.10 | 0.09 | | 870 | 0 |
| | E | 0.02 | 0.38 | 0.44 | 13.5 | 6.9 | 13.0 | 2.1 | 1.40 | 0.72 | 0.012 | 0.09 | 0.03 | | 703 | 0 |
| | F | 0.09 | 0.09 | 0.06 | 11.8 | 15.8 | 7.2 | — | 1.95 | 0.97 | 0.001 | 0.03 | 0.007 | Nb:0.2, La+Ce : 0.007 | 780 | 0 |
| | G | 0.13 | 0.13 | 0.18 | 17.6 | 10.2 | 9.7 | 18.0 | 0.30 | 0.16 | 0.008 | 0.40 | 0.04 | | 712 | 0 |
| | H | 0.17 | 0.05 | 0.04 | 19.2 | 12.5 | 6.5 | 17.3 | 1.25 | 0.58 | 0.003 | 0.01 | 0.05 | Mg+Ca: 0.01 | 746 | 0 |
| | I | 0.06 | 0.22 | 0.09 | 24.3 | 4.7 | 14.9 | 5.7 | 0.77 | 0.39 | 0.008 | 0.05 | 0.06 | V : 0.35 | 1227 | 0 |
| | J | 0.05 | 0.20 | 0.31 | 18.5 | 0.26 | 13.4 | — | 0.88 | 0.41 | 0.002 | 0.008 | 0.04 | Ta:0.85 Ce:0.01 | 1220 | 0 |
| | K | 0.06 | 0.15 | 0.25 | 17.8 | 13.2 | 4.3 | — | 0.94 | 0.38 | 0.005 | 0.02 | 0.01 | | 1156 | 0 |
| Comparative alloys | L | 0.11 | 0.53 | 0.59 | 22.5 | 11.7 | 9.9 | 3.8 | 1.57 | 0.66 | 0.013 | 0.28 | 0.15 | V : 0.42 | 1707 | 100 |
| | M | 0.17 | 0.03 | 0.05 | 9.3 | 15.7 | 5.8 | 15.7 | 1.65 | 0.71 | 0.007 | 0.05 | 0.01 | Nb : 1.30 | 743 | 35 |
| | N | 0.07 | 0.66 | 0.44 | 17.2 | 4.8 | 12.8 | 9.6 | 2.35 | 1.30 | 0.015 | 0.07 | 0.01 | | 2101 | 100 |
| | O | 0.06 | 1.02 | 0.25 | 19.9 | 12.1 | 8.7 | 12.1 | 1.02 | 1.05 | 0.033 | 0.10 | 0.04 | | 697 | 100 |
| | P | 0.01 | 0.08 | 0.03 | 15.2 | 4.8 | 13.6 | 25.3 | 1.55 | 1.30 | 0.005 | 0.31 | 0.006 | Nb : 0.15 | 1452 | 52 |
| | Q | 0.09 | 0.17 | 0.18 | 18.6 | 17.3 | 12.7 | 17.9 | 0.59 | 0.45 | 0.009 | 0.09 | 0.07 | La+Ce+Ca+Mg: 0.12 | 877 | 85 |
| | R | 0.009 | 0.19 | 0.32 | 27.7 | 10.9 | 11.3 | 5.4 | 0.38 | 0.29 | 0.007 | 0.11 | 0.03 | V : 1.53 | 660 | 95 |

*Cracking ratio determined by a circular restriction welding crack test
Welding condition: 100A, 10V, 15 cm/min. Argon flow 15 l/min.

What is claimed is:

1. A heat-resistant alloy consisting of:

C: 0.01–0.20%
Si: not more than 0.50%
Mn: not more than 0.50%
Cr: 10 to 25%
B: not more than 0.030%
Zr: not more than 0.50%
Mo+½W: 5 to 20%
W: 10 to 20% when Mo is less than 10%
Mo: 10 to 16% when W is 3 to 10%
Y: 0.001 to 0.04%
Al: not more than 2.0%
Ti: not more than 1.0% one or more of Ce, La, Mg, Ca, Nb, Ta, V and Hf in the following amount:

Ce, La, Mg, Ca: 0.001 to 0.050% for each and not more than 0.1% in total
Nb, Ta, V, Hf: 0.001 to 3.0% for each and not more than 3.0% in total, with the balance being Ni and unavoidable impurities wherein $Y_E$ is defined in the equation $$Y_E=(Y)\%+1/5(Zr)\%-1.85(S)-3.7(O)\%$$

wherein (Y), (Zr), (S) and (O) represent the amount of those respective elements present in the alloy on a weight basis, is in the range from about −0.01 to 0.02%, 2. A heat-resistant alloy for welded structures consisting of:

C: 0.01–0.20%
Si: not more than 0.50%
Mn: not more than 0.50%
Cr: 10 to 25%
B: not more than 0.030%
Zr: not more than 0.50%
Mo+½W: 5 to 20%
W: 10 to 20% when Mo is less than 10%
Mo: 10 to 16 % when W is 3 to 10%
Y: 0.001 to 0.04%
Al: not more than 2.0%
Ti: not more than 1.0% with the balance being Ni and unavoidable impurities wherein $Y_E$ is defined in the equation $$Y_E=[Y]\%+1/5[Zr]\%-1.85[S]\%-3.7[O]\%$$

wherein [Y], [Zr], [S], and [O] represent the amount of those respective elements present in the alloy on a weight basis, is in the range from about −0.01 to 0.02%, the alloy possesses a creep rupture strength of more than about 300 hours and wherein the amount of tungsten and molybdenum is within the area defined by the points a, b, c, d, e, and f of FIG. 3 hereof.

* * * * *